United States Patent [19]

Konno

[11] Patent Number: 4,848,284

[45] Date of Patent: Jul. 18, 1989

[54] VALVE OPERATING DEVICE FOR MULTICYLINDER INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 137,760

[22] Filed: Dec. 24, 1987

[30] Foreign Application Priority Data

Dec. 27, 1986 [JP] Japan ..... 61-311631

[51] Int. Cl.[4] ..... F01L 1/34

[52] U.S. Cl. ..... 123/90.16; 123/198 F; 123/321; 123/347

[58] Field of Search ..... 123/90.16, 90.17, 90.39, 123/90.40, 90.41, 90.44, 198 F, 321, 324, 347, 348

[56] References Cited

U.S. PATENT DOCUMENTS

| | | | |
|---|---|---|---|
| 4,473,047 | 9/1984 | Jakuba et al. | 123/321 X |
| 4,545,342 | 10/1985 | Nakano et al. | 123/198 F |
| 4,656,977 | 4/1987 | Nagahiro et al. | 123/90.16 |
| 4,700,684 | 10/1987 | Pischinger et al. | 123/348 X |
| 4,727,830 | 3/1988 | Nagahiro et al. | 123/90.16 |
| 4,727,831 | 3/1988 | Nagahiro et al. | 123/90.16 |
| 4,741,297 | 5/1988 | Nagahiro et al. | 123/90.16 |
| 4,741,307 | 5/1988 | Meneely | 123/347 X |

*Primary Examiner*—Willis R. Wolfe

*Attorney, Agent, or Firm*—Lyon & Lyon

[57] ABSTRACT

A valve operating device for the intake or exhaust valves of a multicylinder internal combustion engine. Each cylinder has a valve operating mechanism associated therewith for opening and closing intake or exhaust valves associated with that cylinder in at least two different manners for different engine speeds. The cylinders are divided into two or more groups with each of said valve operating mechanisms being arranged to operate the intake or exhaust valves associated with the cylinders in one of the groups in a different operation mode from the intake or exhaust valves associated with the cylinders in another of the groups, at least under a certain operating condition of the engine, such as at low speed. The various embodiments disclosed different arrangements for the valve operating mechanisms for improving engine operation over various ranges of engine speed.

11 Claims, 13 Drawing Sheets

VALVE OPERATING DEVICE FOR MULTICYLINDER INTERNAL COMBUSTION ENGINE

The present invention relates to valve operating device for a multicylinder internal combustion engine that includes a plurality of valve operating mechanisms associated respectively with each of cylinders of the engine for opening and closing intake or exhaust valves associated respectively with the cylinders in different modes depending on the engine speed for improving operation of the engine at different speeds.

Heretofore, valve operating devices of this general type have been known, as disclosed, for example, in U.S. Pat. Nos. 4,537,164, 4,537,165, 4,545,342, 4,5356,732, 4,656,977, 4,612,884, 4,576,128 and 4,587,936 owned by the assignee of this application.

In the conventional valve operating device, valve operating mechanisms associated with the engine cylinders, respectively, are of an identical structure. Under a certain operating condition of the engine, the intake or exhaust valves of the engine cylinders are opened and closed in the same mode. With the valve operating device of this type, it is possible to increase the precision of valve operation control by varying the operation mode of the intake or exhaust valves of the respective cylinders dependent on the operating conditions of the engine. If the intake or exhaust valves can be operated in different modes for the engine cylinders, then valve operation control can be performed with a greater degree of precision.

It is an object of the present invention to provide a valve operating device for a multicylinder internal combustion engine which operates intake or exhaust valves in different modes among the engine cylinders thereby to increase the precision of valve operation control.

According to the present invention, engine cylinders are divided into a plurality of groups, and each of the valve operating mechanisms is arranged to operate the intake or exhaust valves associated with the cylinders in one of the groups in a different operation mode from the intake or exhaust valves associated with the cylinders in another of the groups, at least under a certain operating condition of the engine.

A number of embodiments of the present invention will hereinafter be described with reference to the drawings, wherein:

FIGS. 1 through 5 show a first embodiment of the present invention wherein FIG. 1 is a plan view;

FIG. 2 is an enlarged cross-sectional view taken along line Ii—II of FIG. 1;

FIG. 3 is an enlarged cross-sectional view taken along line III—III of FIG. 1;

FIG. 4 is an enlarged cross-sectional view taken along line IV—IV of FIG. 2;

FIG. 5 is an enlarged cross-sectional view taken along line V—V of FIG. 1;

Figure 1:
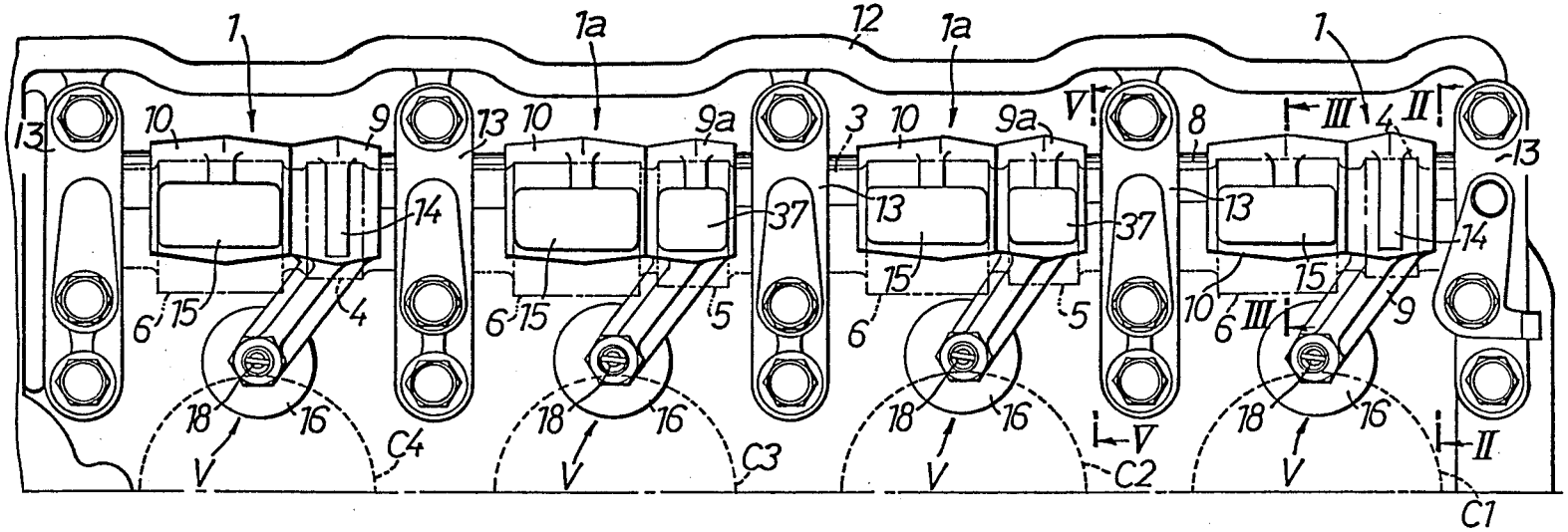
Figure 4:
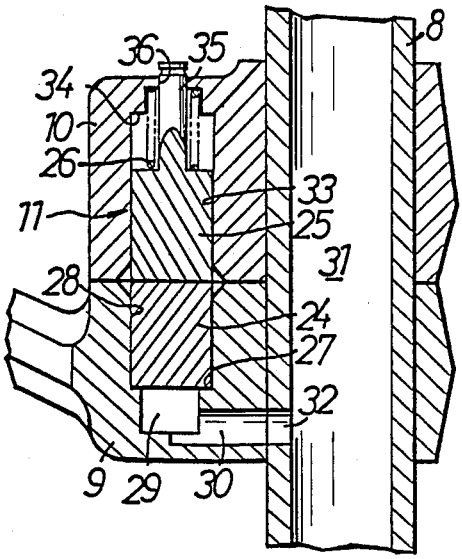
Figure 12:
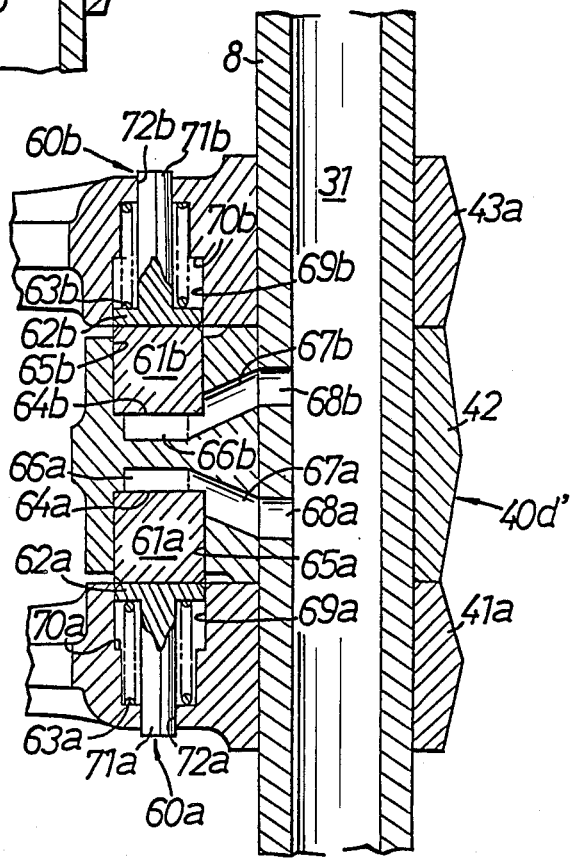
Figure 11:
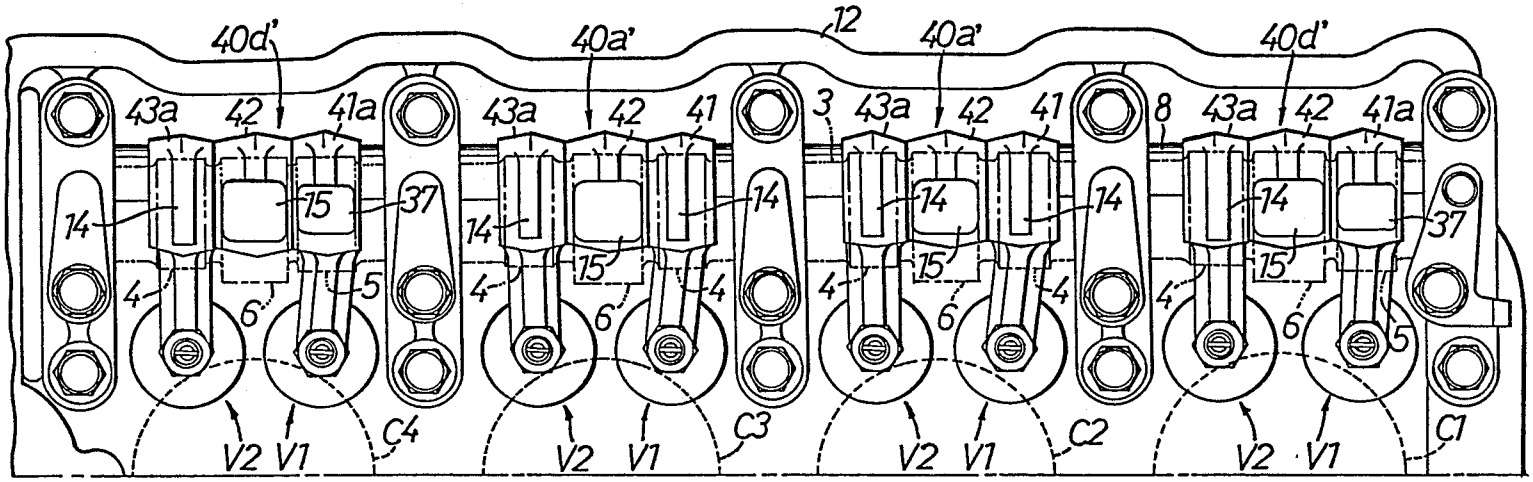

FIGS. 11 and 12 are similar to FIGS. 1 and 4 and show a sixth embodiment of the present invention; and FIGS. 13, 14, 15, and 16 are plan views similar to FIG. 1, showing seventh, eighth, ninth and tenth embodiments of the present invention.

In FIG. 1 which shows a first embodiment of the present invention, wherein a four-cylinder internal combustion engine includes first through fourth cylinders C1, C2, C3, C4 each having a single intake valve V associated therewith. The intake valves V of the first and fourth cylinders C1, C4 are opened and closed by identical valve operating mechanisms 1, respectively, and the intake valves V of the second and third cylinders C2, C3 are opened and closed by identical valve operating mechanisms 1*a*, respectively, that differ in operation from mechanism 1.

Figure 2:
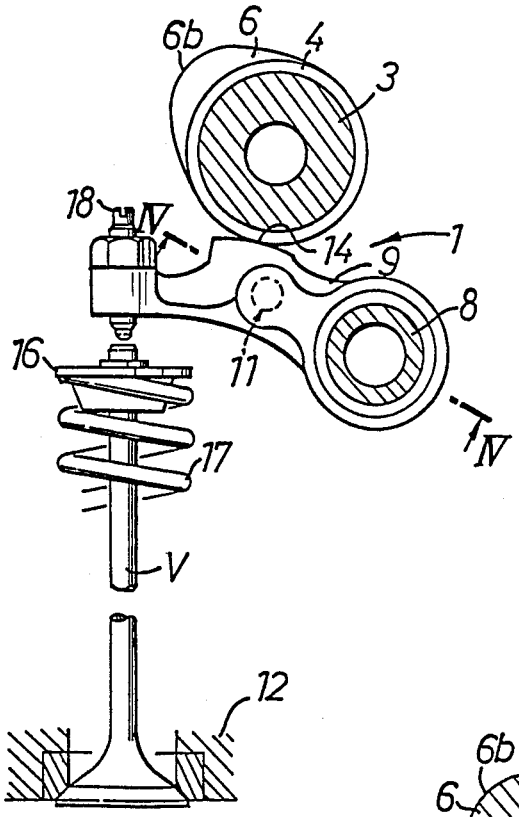
Figure 3:
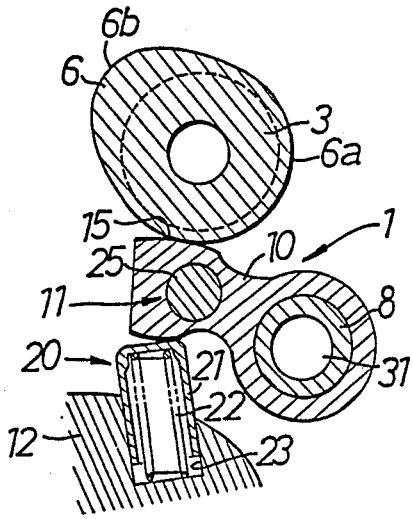

As shown in FIGS. 2 and 3, each of the valve operating mechanisms 1 comprises a circular raised portion 4 and a high-speed cam 6 which are integrally formed on a camshaft 3 rotatable by the crankshaft (not shown) of the engine at a speed ratio of ½ of the speed of rotation of the crankshaft, a pair of rocker arms 9, 10 pivotally supported as cam followers on a rocker shaft 8 extending parallel to the camshaft 3, and a selective coupling mechanism 11 disposed between the rocker arms 9, 10.

The raised portion 4 is of a circular shape concentric with the camshaft 3 and even though it does not include a cam lobe it may be referred to herein as a "cam". The high-speed cam 6 is integrally formed on the camshaft 3 adjacent to the raised portion 4. The high-speed cam 6 has an arcuate base circle portion 6*a* concentric with the camshaft 3 and a cam lobe 6*b* projecting radially outwardly from the base circle portion 6*a*. The camshaft 3 is rotatably supported by cam holders 13 mounted on a cylinder head 12.

The rocker shaft 8 is fixedly positioned below the camshaft 3. On the rocker shaft 8, there are swingably supported the rocker arm 9 having on its upper side a sliding surface 14 held in slidable contact with the raised portion 4, and the rocker arm 10 having on its upper side a cam slipper 15 held in slidable contact with the high-speed cam 6, the rocker arms 9, 10 being disposed adjacent to each other.

The intake valves V are operatively associated with the respective rocker arms 9. Each of the intake valves V is normally urged to move in a valve closing direction, i.e., upwardly, by a valve spring 17 disposed between a flange 16 mounted on the upper portion of the intake valve V and the cylinder head 12. A tappet screw 18 is adjustably threaded through the distal end of the rocker arm 9 in abutment against the upper end of the intake valve V.

The cam slipper 15 of each of the other rocker arms 10 is normally held in slidable contact with the high-speed cam 6 by resilient urging means 20 disposed between the rocker arm 10 and the cylinder head 12. The resilient urging means 20 comprises a cylindrical bottomed lifter 21 with its closed end held against the lower surface of the rocker arm 10, and a lifter spring 22 disposed between the lifter 21 and the cylinder head 12. The lifter 21 is slidably fitted in a bottomed hole 23 defined in the cylinder head 12.

As shown in FIG. 4, the selective coupling mechanism 11 comprises a connecting pin 24 capable of interconnecting the rocker arms 9, 10, a stopper 25 for limiting the movement of the connecting pin 24, and a return spring 26 for urging the connecting pin 24 and the stopper 25 in a direction to disconnect the rocker arms 9, 10 from each other.

The rocker arm 9 has a first guide hole 28 opening toward the other rocker arm 10 and a step 27 facing the open end thereof. The first guide hole 28 extends parallel to the rocker shaft 8. The connecting pin 24 is slidably fitted in the first guide hole 28. The closed end of the first guide hole 28 and the connecting pin 24 define therebetween a hydraulic pressure chamber 29. The step 27 is positioned in the first guide hole 28 such that when one end of the connecting pin 24 abuts against the step 27, the other end of the connecting pin 24 is positioned between the rocker arms 9, 10. The rocker arm 9 has an oil passage 30 defined therein in communication with the hydraulic pressure chamber 29. The rocker shaft 8 has an oil pressure chamber 31 communicating with an oil pressure supply source (not shown). The oil passage 30 and the oil pressure supply passage 31 are in communication with each other through a communication hole 32 defined in a side wall of the rocker shaft 8, irrespective of the angular position of the rocker arm 9 on the rocker shaft 8.

The rocker arm 10 has a second guide hole 33 defined therein for registration with the first guide hole 28 and extending parallel to the rocker shaft 8. The stopper 25 is slidably fitted in the second guide hole 33. The second guide hole 33 has a step 34 near the closed end thereof for limiting movement of the stopper 25. The stopper 25 has a coaxial smaller-diameter shaft 35 movably inserted through a guide hole 36 defined coaxially in the closed end the of the second guide hole 33. The return spring 26 is disposed around the shaft 35 between the closed end of the second guide hole 33 and the stopper 25 for normally urging the mutually abutting connecting pin 24 and stopper 25 in a direction to disconnect the rocker arms 9, 10, i.e., toward the hydraulic pressure chamber 29.

When no high oil pressure is supplied to the hydraulic pressure chamber 29, the connecting pin 24 and the stopper 25 are in the position to disconnect the rocker arms 9, 10. In this position, the abutting surfaces of the connecting pin 24 and the stopper 25 are positioned between the rocker arms 9, 10. Therefore, the rocker arms 9, 10 are not interconnected, and are angularly displaceable with respect to each other. When high oil pressure is supplied to the hydraulic pressure chamber 29, the connecting pin 24 and the stopper 25 are moved away from the hydraulic pressure chamber 29 against the force of the return spring 26 until the connecting pin 24 is slidably inserted into the second guide hole 33. Therefore, the rocker arms 9, 10 are interconnected and operable in the same mode.

Figure 5:
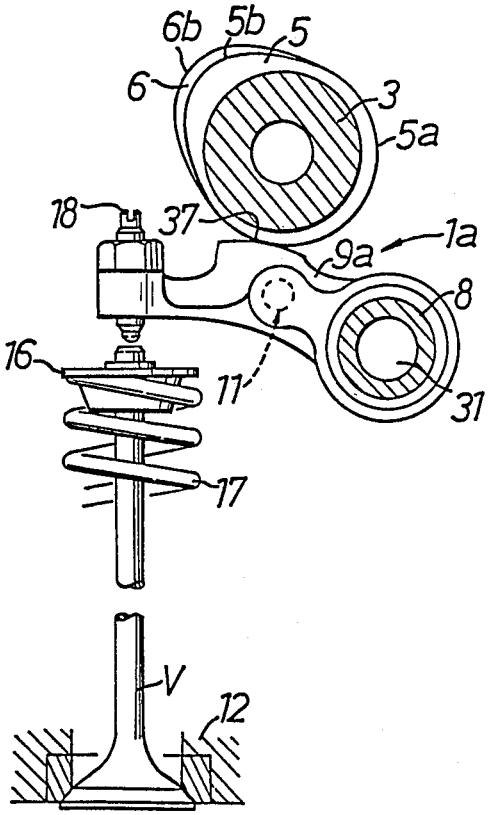

As shown in FIG. 5, each of the valve operating mechanisms 1*a* comprises a low-speed cam 5 and a high-speed cam 6 which are integrally formed on the camshaft 3, a pair of rocker arms 9*a*, 10 angularly movably supported on the rocker shaft 8, and a selective coupling mechanism 11 disposed between the rocker arms 9*a*, 10. The camshaft 3 and rocker shaft 8 are shared by the valve operating mechanism 1 and 1*a*.

The low-speed cam 5 is integrally formed on the camshaft 3 and has a base circle portion 5*a* and a cam lobe 5*b* having a smaller angular extent than that of the cam lobe 6*b* of the high-speed cam 6 and projecting radially outwardly to a smaller extent than that of the cam lobe 6*b*. The rocker arm 9*a* has on its upper side a cam slipper 37 held in slidable contact with the low-speed cam 5. The intake valves V are operatively associated with the respective rocker arms 9.

Operation of the first embodiment will be described. During low-speed operation of the engine, no high oil pressure is supplied to the oil pressure supply passage 31 and hence the hydraulic pressure chambers 29 of the selective coupling mechanisms 11 of the respective valve operating mechanisms 1, 1*a*, are therefore in the position to disconnect the rocker arms 9, 10. In this position the rocker arms 9 associated with the first and fourth cylinders C1, C4 are not angularly moved in sliding contact with the raised portions 4, and the intake valves V are disabled or remain closed. The rocker arms 9*a* associated with the second and third cylinders C2, C3 are angularly moved in sliding contact with the low-speed cams 5 to cause the intake valves V to be opened and closed at the timing and lift according to the cam profile of the low-speed cams 5. The rocker arms 10 engage and are pivoted by the cams 6 but they do not effect the opening and closing of any of the valves V.

During high-speed operation of the engine, high oil pressure is supplied to the oil pressure supply passage 31 and acts in the hydraulic pressure chambers 29 of the respective selective coupling mechanisms 11. In each of the selective coupling mechanisms 11, the connecting pin 24 and the stopper 25 are moved under hydraulic pressure toward the position to interconnect the rocker arms against the bias of the return spring 26, until the connecting pin 24 is slidably inserted in the second guide hole 33. Therefore, the rocker arms 9, 10 for the first and fourth cylinders C1, C4 are interconnected, and the rocker arms 9*a*, 10 for the second and third cylinders C2, C3 are interconnected. With the rocker arms thus connected, the rocker arms 9, 9*a* are angularly moved with the rocker arms 10 which are angularly moved in sliding contact with the high-speed cams 6, so that the intake valves V are opened and closed at the timing and lift according to the cam profile of the high-speed cams 6.

When the engine operates in a low-speed range, therefore, the intake valves V associated with the first and fourth cylinders C1, C4 are disabled for thereby reducing fuel consumption. When the engine operates in a high-speed range, all of the valves V are operated to the fullest extent by the high-speed cams 6.

Figure 6:
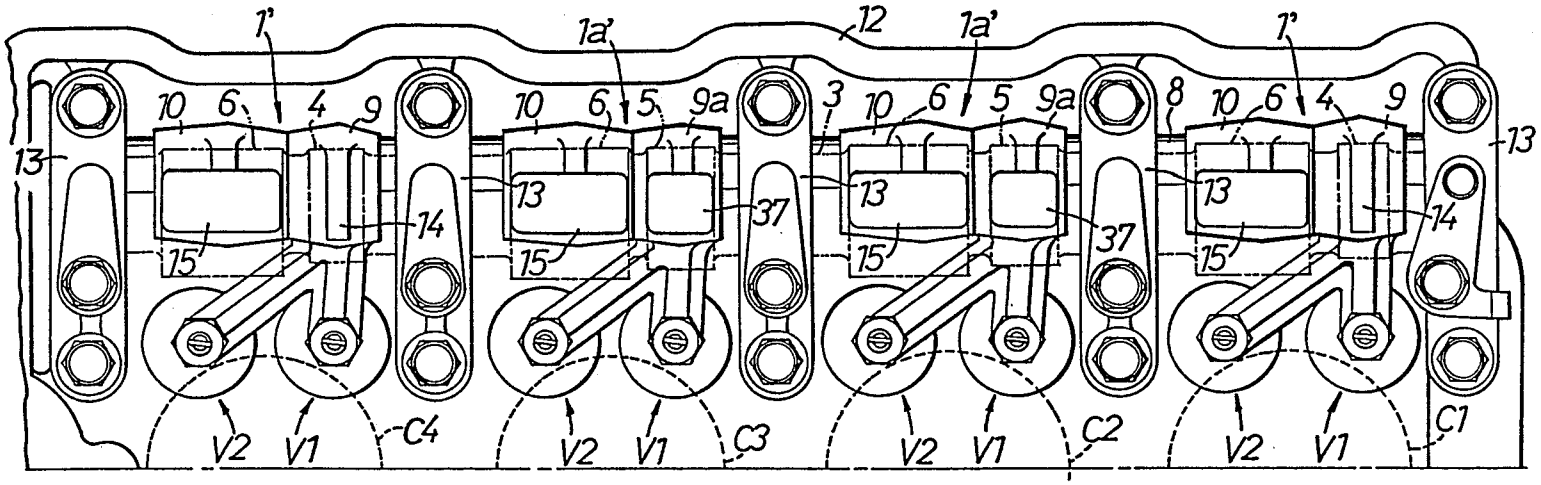
FIG. 6 is a plan view similar to FIG. 1, showing a second embodiment of the invention.

FIG. 6 shows a second embodiment of the present invention, wherein the first and fourth cylinders C1, C4 are associated with respective valve operating mechanisms 1' including respective rocker arms 9 and the second and third cylinders C2, C3 are associated with respective valve operating mechanisms 1*a'* including respective rocker arms 9*a*. Each of the rocker arms 9, 9*a* is operatively associated with a pair of intake valves V1, V2. cams 4, 5 and 6 are provided on camshaft 3 identical to the first embodiment. Thus, according to this second embodiment, during low-speed operation of the engine, the intake valves V1, V2 associated with the first and fourth cylinders C1, C4 are disabled.

Figure 7:
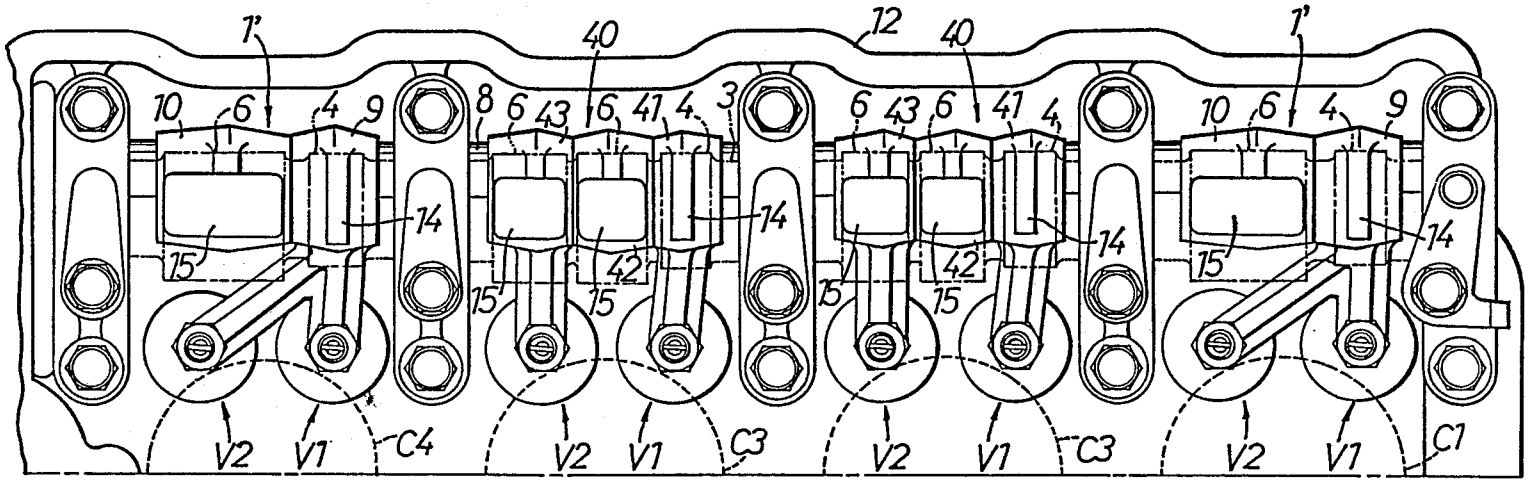
FIGS. 7 and 8 are similar to FIGS. 1 and 4 and show a third embodiment of the present invention.
Figure 8:
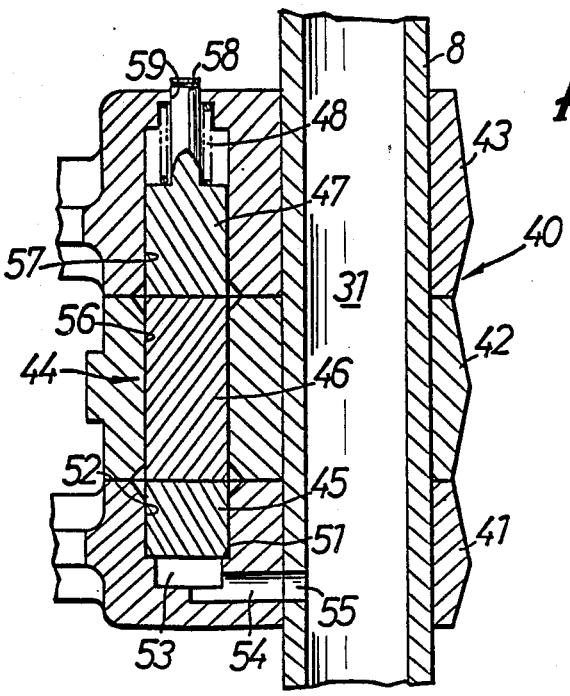

FIGS. 7 and 8 illustrate a third embodiment of the present invention. Those parts shown in FIGS. 7 and 8 which are identical to those in the previous embodiments are denoted by identical reference numerals and will not be described in detail. The cylinders C1 through C4 each have a pair of intake valves V1, V2 associated therewith. The intake valves V1, V2 of the first and fourth cylinders C1, C4 are opened and closed by valve operating mechanism 1', respectively, which are identical to those shown in FIGS. 6, and the intake valves V1, V2 of the second and third cylinders C2, C3 are opened and closed by valve operating mechanisms 40 respectively.

Each of the valve operating mechanisms 40 comprises a raised portion 4 and two high-speed cams 6 which are integrally formed on the camshaft 3, first, second and third rocker arms 41, 42, 43 pivotally supported on the rocker shaft 8, and a selective coupling mechanisms 44 for selectively interconnecting and disconnecting the rocker arms 41, 42, 43.

The rocker arms 41 have on their upper sides respective sliding surfaces 14 held in slidable contact with the raised portions 4, and the second and third rocker arms 42, 43 have on their upper sides respective cam slippers 15 held in slidable contact with the high-speed cams 6. The second rocker arms 42 are angularly movably supported on the rocker shaft 8 between the first and third rocker arms 41, 43, and the intake valves V1, V2 are operatively associated with the first and third rocker arms 41, 43.

Each of the selective coupling mechanisms 44 comprises a first connecting pin 45 capable of interconnecting the first and second rocker arms 41, 42, a second connecting pin 46 capable of interconnecting the second and third rocker arms 42, 43, a stopper 47 for limiting the movement of the connecting pins 45, 56, and a return spring 48 for urging the connecting pins 45, 46 and the stopper 47 to disconnect the rocker arms from each other.

The first rocker arm 41 has a first guide hole 52 opening toward the second rocker arm 42 and having a step 51 facing the open end thereof, the first guide hole 52 extending parallel to the rocker shaft 8. The first connecting pin 45 is slidably fitted in the first guide hole 52. The closed end of the first guide hole 52 and the first connecting pin 45 define therebetween a hydraulic pressure chamber 53. The step 51 is positioned in the first guide hole 52 such that when one end of the first connecting pin 45 abuts against the step 51, the other end of the first connecting pin 45 is positioned between the first and second rocker arms 41, 42. The first rocker arm 41 has an oil passage 54 defined therein in communication with the hydraulic pressure chamber 53. The oil passage 54 and the oil pressure supply passage 31 are in communication with each other at all times through a communication hole 55 defined in a side wall of the rocker shaft 8, irrespective of the angular position of the first rocker arm 41 on the rocker shaft 8.

The second rocker arm 41 has a guide hole 56 defined therein with the same diameter as that of the first guide hole 52. The guide hole 56 extends between the opposite side surfaces of the second rocker arm 42. The second connecting pin 46 having the same length as the entire length of the guide hole 56 is slidably inserted in the guide hole 56.

The third rocker arm 43 has a guide hole 57 defined therein in registration with the guide hole 56 and opening toward the second rocker arm 42. The guide hole 57 extends parallel to the rocker shaft 8. The inside diameter of the guide hole 57 is the same as the guide hole 56. The stopper 47 is slidably fitted in the guide hole 57. The stopper 47 has a coaxial smaller-diameter shaft 58 movably inserted through a guide hole 59 defined coaxially in the closed end the guide hole 57. The return spring 48 is disposed around the shaft 58 between the closed end of the guide hole 57 and the stopper 47 for normally urging the mutually abutting first and second connecting pins 45, 46 and stopper 47 in a direction to disconnect the rocker arms i.e., toward the hydraulic pressure chamber 53.

When no high oil pressure is supplied to the hydraulic pressure chamber 53, the first and second connecting pins 45, 46 and the stopper 47 are in the position to disconnect the rocker arms under the force of the return spring 48. In this position, the abutting surfaces of the first and second connecting pins 45, 46 are positioned between the first and second rocker arms 41, 42, and the abutting surfaces of the second connecting pin 46 and the stopper 47 are positioned between the second and third rocker arms 42, 43. Therefore, the rocker arms 41 through 43 are not interconnected. When high oil pressure is supplied to the hydraulic pressure chamber 53, the first and second connecting pins 45, 46 and the stopper 47 are moved away from the hydraulic pressure chamber 53 against the force of the return spring 48 until the first connecting pin 45 is slidably inserted into the guide hole 56 and the second connecting pin 46 is slidably inserted into the guide hole 57. Therefore, the rocker arms 41 through 43 are interconnected.

In this third embodiment shown in FIGS. 7 and 8, during low-speed operation of the engine, the intake valves V1, V2 associated with the first and fourth cylinders C1, C4 are disabled or remain closed, the intake valves V1 associated with the second and third cylinders C2, C3 are disabled or remain closed, and the intake valves V2 associated with the second and third cylinders C2, C3 are opened and closed at the timing and lift according to the cam profile of the high-speed cams 6. During high-speed operation of the engine, the intake valves V1, V2 associated with the cylinders C1 through C4 are opened and closed at the timing and lift according to the cam profile of the high-speed cams 6.

With this third embodiment, the power output of the engine can be increased, the load on the valve operating mechanisms during low-speed operation of the engine can be reduced, the fuel consumption can be reduced, and a stable engine operation can be achieved, all with a relatively small number of components.

Figure 9:
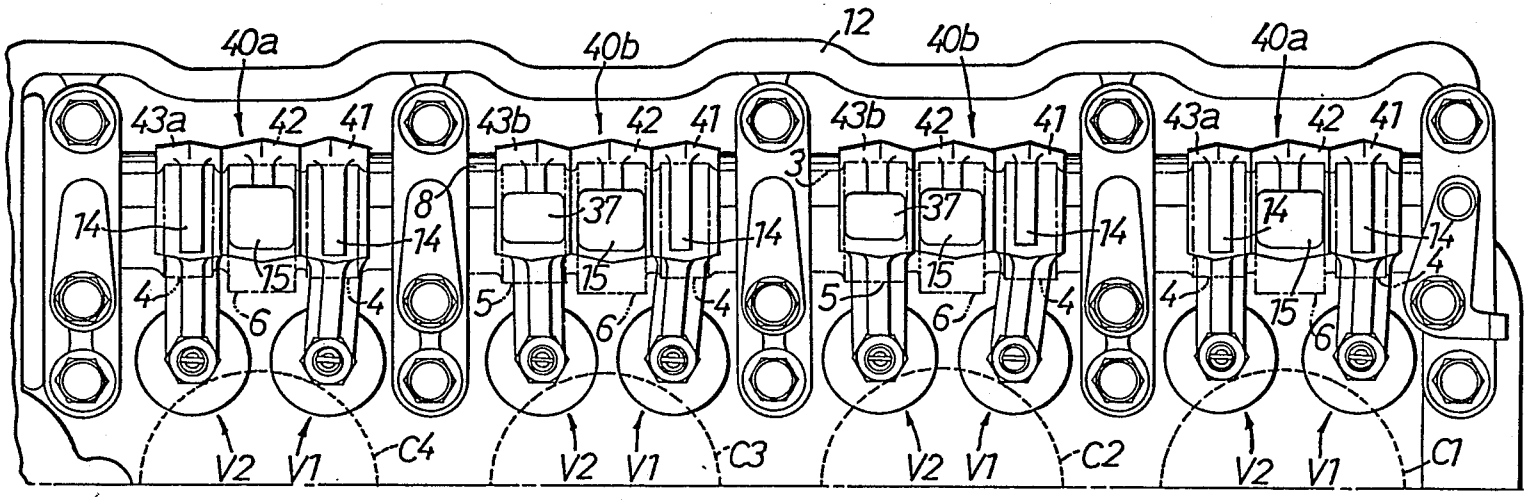
FIGS. 9 and 10 are plan views similar to FIG. 1, showing fourth and fifth embodiments of the present invention.

FIG. 9 shows a fourth embodiment of the present invention. Each of the first through fourth cylinders C1 through C4 has a pair of intake valves V1, V2, associated therewith and the intake valves V1, V2 of the first and fourth cylinders C1, C4 are opened and closed by valve operating mechanism **40*a*, whereas the intake valves V1, V2 of the second and third cylinders C2, C3 are opened and closed by valve operating mechanisms 40*b***.

Each of the valve operating mechanisms **40*a* comprises a first rocker arm 41 having a sliding surface 14 held in slidable contact with the raised portion 4, a second rocker arm 42 having a cam slipper 15 held in slidable contact with the raised portion 4. The rocker arms 41, 42, 43*a* are selectively connectable and disconnectable and angularly movably supported on the rocker shaft 8. The intake valves V1, V2 are operatively associated with the first and third rocker arms 41, 43*a***, respectively.

Each of the valve operating mechanism **40*b* comprises a first rocker arm 41 having a sliding surface 14 held in slidable contact with the raised portion 4, a second rocker arm 42 having a cam slipper 15 held in slidable contact with the high-speed cam 6, and a third rocker arm 43*b* having a cam slipper 37 held in slidable contact with the low-speed cam 5. The rocker arms 41, 42, 43*b* are selectively connectable and disconnectable and angularly movably supported on the rocker shaft 8**.

The intake valves V1, V2 are operatively associated with the first and third rocker arms 41, 43*b*, respectively.

According to this fourth embodiment shown in FIG. 9, during low-speed operation of the engine, the intake valves V1, V2 associated with the first and fourth cylinders C1, C4 are disabled or remain closed, the intake valves V1 associated with the second and third cylinders C2, C3 are disabled or remain closed, and the intake valves V2 associated with the second and third cylinders C2, C3 are opened and closed at the timing and lift according to the cam profile of the low-speed cams 5. During high-speed operation of the engine, the intake valves V1, V2 associated with the cylinders C1 through C4 are opened and closed at the timing and lift according to the cam profile of the high-speed cams 6.

Figure 10:
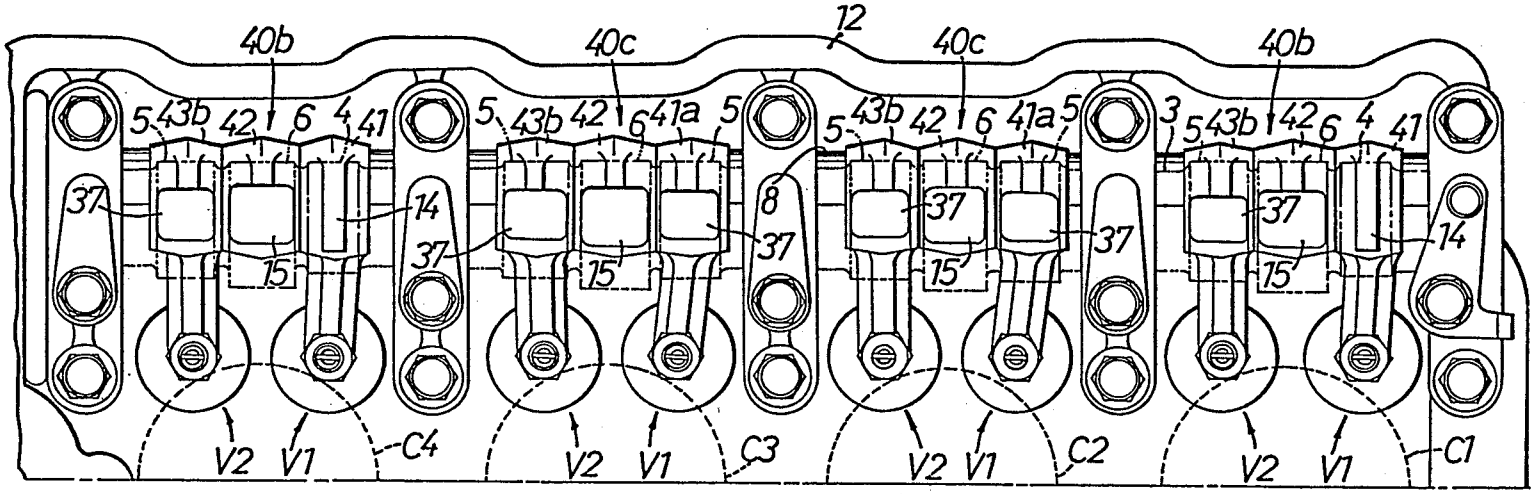

FIG. 10 illustrates a fifth embodiment of the present invention. The intake valves V1, V2 of the first and fourth cylinders C1, C4 are opened and closed by valve operating mechanisms 40*b*, whereas the intake valves V1, V2 of the second and third cylinders C2, C3 are opened and closed by valve operating mechanisms 40*c*.

Each of the valve operating mechanisms 40*b* are the same as mechanisms 40*b* described with respect to the embodiment of FIG. 9. Each of the valve operating mechanisms 40*c* comprises a first rocker arm 41*a* having a cam slipper 37 held in slidable contact with the low-speed cam 5, a second rocker arm 42 having a cam slipper 15 held in slidable contact with the high-speed cam 6, and a third rocker arm 43*b* having a cam slipper 37 held in slidable contact with the low-speed cam 5. The rocker arms 41*a*, 42, 43*b* are selectively connectable and disconnectable and angularly movably supported on the rocker shaft 8. The intake valves V1, V2 are operatively associated with the first and third rocker arms 41*a*, 43*b*, respectively.

According to this fifth embodiment, during low-speed operation of the engine, the intake valves V1 associated with the first and fourth cylinders C1, C4 are disabled or remain closed, at the intake valves V2 associated with the first and fourth cylinders C1, C4 are opened and closed at the timing and lift according to the cam profile of the low-speed cams 5, and the intake valves V1, V2 associated with the second and third cylinders C2, C3 are opened and closed at the timing and lift according to the cam profile of the low-speed cams 5. During high-speed operation of the engine, the intake valves V1, V2 associated with the cylinders C1 through C4 are opened and closed at the timing and lift according to the cam profile of the high-speed cams 6. When the engine operates in a low-speed range, therefore, the only intake valves V1 associated with the first and fourth cylinders C1, C4 remain closed and the intake valves V2 are opened and closed by the low-speed cams 5. This mode of operation has effects close to those of a mode in which the first and fourth cylinders are disabled but results in a smoother operation because all four cylinders are in operation.

FIGS. 11 and 12 show a sixth embodiment of the present invention. The intake valves V1, V2 of the first and fourth cylinders C1, C4 are opened and closed by valve operating mechanisms 40*d*', whereas the intake valves V1, V2 of the second and third cylinders C2, C3 are opened and closed by valve operating mechanisms 40*a*'.

Each of the valve operating mechanisms 40*d*' comprises a first rocker arm 41*a* having a cam slipper 37 held in slidable contact with the low-speed cam 5 and operatively associated with the intake valve V1, a second rocker arm 42 having a cam slipper 15 held in slidable contact with the high-speed cam 6, a third rocker arm 43*a* having a sliding surface 14 held in slidable contact with the raised portion 4 and operatively associated with the intake valve V2, a selective coupling mechanism 60*a* for selectively interconnecting and disconnecting the first and second rocker arms 41*a*, 42, and a selective coupling mechanisms 60*b* for selectively interconnecting and disconnecting the second and third rocker arms 42, 43*a*.

The selective coupling mechanisms 60*a* comprises a connecting pin 61*a* capable of interconnecting the first and second rocker arms 41*a*, 42, a stopper 62*a* for limiting the movement of the connecting pin 61*a*, and a return spring 63*a* for urging the connecting pin 61*a* and the stopper 62*a* to disconnect the rocker arms from each other.

The second rocker arm 42 has a first guide hole 65*a* opening toward the first rocker arm 41*a* and having a step 64*a* facing the open end thereof. The first guide hole 65*a* extends parallel to the rocker shaft 8. The connecting pin 61*a* is slidably fitted in the first guide hole 65*a*. The closed end of the first guide hole 65*a* and the connecting pin 61*a* define therebetween a hydraulic pressure chamber 66*a*. The second rocker arm 42 has an oil passage 65*a* defined therein in communication with the hydraulic pressure chamber 66*a*. The oil passage 65*a* and the oil pressure supply passage 31 are in communication with each other at all times through a communication hole 68*a* defined in a side wall of the rocker shaft 8.

The first rocker arm 41*a* has a second guide hole 69*a* defined therein in registration with the first guide hole 65*a* and extending parallel to the rocker shaft 8. The stopper 62*a* in the form of a flat plate held against the connecting pin 61*a* is slidably fitted in the second guide hole 69*a*. The stopper 62*a* has a coaxial smaller-diameter shaft 71*a* movably inserted through a guide hole 72*a* defined in the closed end of the second guide hole 69*a*.

The other selective coupling mechanism 60*b* is basically identical in structure to the selective coupling mechanisms 60*a*. Those parts of the selective coupling selective 60*b* which correspond to those of the selective coupling mechanism 60*a* are denoted by corresponding reference numerals with a suffix b, and will not be described in detail.

The set load of the return spring 63*a* is selected to be smaller than the set load of the return spring 63*b*. Therefore, when no oil pressure is supplied to the oil pressure supply passage 31, the rocker arms 41*a*, 42 and 43*a* all remain disconnected, when relatively low oil pressure is supplied to passage 31, only the selective coupling mechanism 60*a* is operated to connect the first and second rocker arms 41*a*, 42 to each other, and when relatively high oil pressure is supplied to the oil pressure supply passage 31, the other selective coupling mechanisms 60*b* is also operated to interconnect all of the rocker arms 41*a*, 42, 43*a*.

Each of the valve operating mechanisms 40*a*' comprises a first rocker arm 41 having a sliding surface 14 held in slidable contact with the raised portion 4 and operatively associated with the intake valve V1, a second rocker arm 42 having a cam slipper 125 held in slidable contact with the high-speed cam 6, a third rocker arm 43*a* having a sliding surface 14 held in slidable contact with the raised portion 4 and operatively associated with the intake valve V2, a selective coupling mechanism (not shown) disposed between the first and second rocker arms 41, 42 for selectively interconnecting and disconnecting them when relatively low oil pressure is supplied to the oil pressure supply passage 31, and a selective coupling mechanism (not shown) disposed between the second and third rocker arms 42, 43*a* for selectively interconnecting and disconnecting them when relatively high oil pressure is supplied to the oil pressure supply passage 31.

Operation of the sixth embodiment will be described below. During low-speed operation of the engine, the oil pressure passage 31 is released of oil pressure. Therefore, both of the selective coupling mechanisms 60*a*, 60*b* are in the rocker arm disconnecting position. The intake valves V1 associated with the first and fourth cylinders C1, C4 are opened and closed at the timing and lift according to the cam profile of the low-speed cams 5, and the intake valves V2 associated with the first and fourth cylinders C1, C4 are disabled or remain closed. The intake valves VI, V2 associated with the second and third cylinders C2, C3 are disabled or remain closed.

During medium-speed operation of the engine, relatively low pressure is supplied to the oil pressure supply passage 31. The first and second rocker arms 41*a*, 42 and 41, 42 are not interconnected. Therefore, the intake valves V1 associated with the first and fourth cylinders C1, C4 are opened and closed at the timing and lift according to the cam profile of the high-speed cams 6, and the intake valves V2 associated with the first and fourth cylinders C1, C4 are disabled or remain closed. Similarly, the intake valves V1 associated with the second and third cylinders C2, C3 are opened and closed at the timing and lift according to the cam profile of the high-speed cams 6, and the intake valves V2 associated with the second and third cylinders C2, C3 are disabled or remain closed.

During high-speed operation of the engine, relatively high pressure is supplied to the oil pressure supply passage 31. All of the rocker arms 41*a*, 42, 43*a* and 41, 42, 43*a* are interconnected, and the intake valves V1, V2 are opened and closed at the timing and lift according to the cam profile of the high-speed cams 6.

According to this sixth embodiment, the valves are operated selectively in three modes so that the low- and high-load ranges of the engine can be controlled more appropriately, and the transition between the engine power output characteristics in the low- and high-load ranges of the engine is smoothed.

Figure 13:
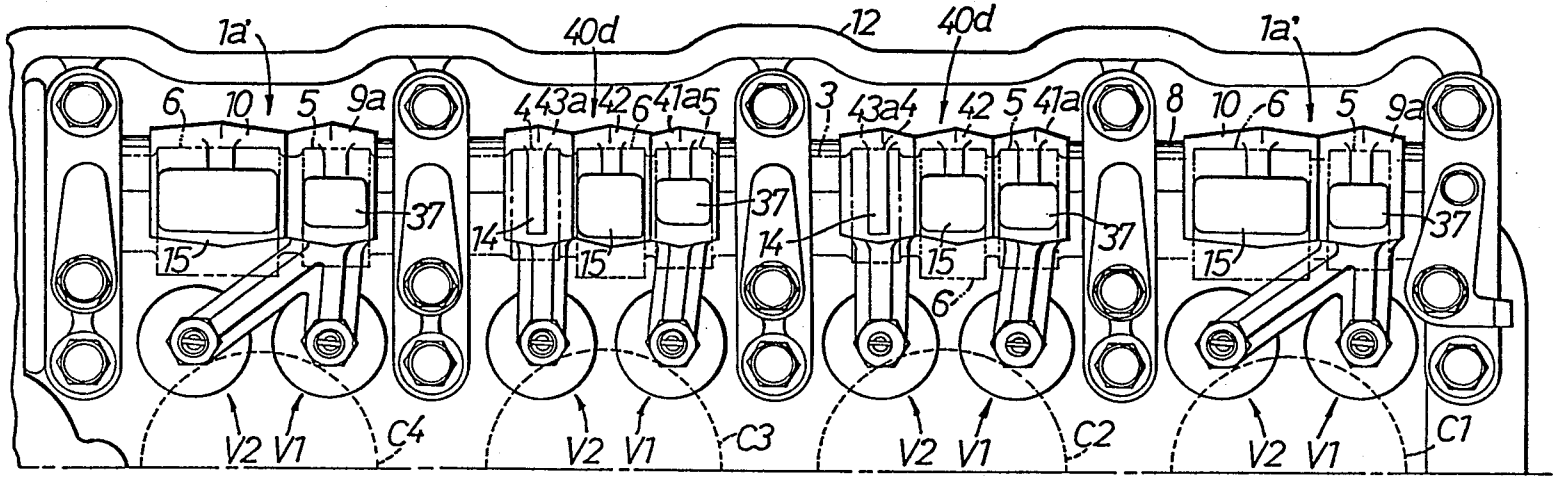

FIG. 13 shows a seventh embodiment of the present invention. The intake valves V1, V2 of the first and fourth cylinders C1, C4 are opened and closed by valve operating mechanisms 1*a*', whereas the intake valves V1, V2 of the second and third cylinders C2, C3 are opened and closed by valve operating mechanisms 40*d*. The valve operating mechanisms 1*a*' and the valve operating mechanisms 40*d* have different oil pressure systems, and are operated at different timing for interconnecting and disconnecting the rocker arms.

Each of the valve operating mechanisms 40*d* comprises a first rocker arm 41 having a cam slipper 37 held in slidable contact with the low-speed cam 5 and operatively associated with the intake valve V1, a second rocker arm 42 having a cam slipper 15 held in slidable contact with the high-speed cam 6, and a third rocker arm 43*a* having a sliding surface 14 held in slidable contact with the raised portion 4 and operatively associated with the intake valve V2. The rocker arms 41*a*, 42, 43*a* are selectively connectable and disconnectable.

During low speed operation of the engine, the valve operating mechanisms 1*a*', 40*d* are in the rocker arm disconnecting position. The intake valves V1, V2 associated with the first and fourth cylinders C1, C4 are opened and closed at the timing and lift according to the cam profile of the low-speed cams 5, the intake valves V1 associated with the second and third cylinders C2, C3 are opened and closed at the timing and lift according to the cam profile of the low-speed cams 5, and the intake valves V2 associated with the second and third cylinders C2, C3 are disabled or remain closed.

During medium-speed operation of the engine, only the valve operating mechanisms 40*d* are in the rocker arm connecting position. Therefore, the intake valves V1, V2 associated with the first and fourth cylinders C1, C4 are opened and closed at the timing and lift according to the cam profile of the low-speed cams 5, and the intake valves V1, V2 associated with the second and third cylinders C2, C3 are opened and closed at the timing and lift according to the cam profile of the high-speed cams 6.

During high-speed operation of the engine, the valve operating mechanisms 1*a*', 40*d* are in the rocker arm connecting position. The intake valves V1, V2 of the cylinders C1 through C4 are opened and closed at the timing and lift according to the cam profile of the high-speed cams 6.

According to this seventh embodiment, the valves are operated selectively in three modes by the combination of the valve operating mechanisms 1*a*', 40*d* each switchable between two modes.

Figure 14:
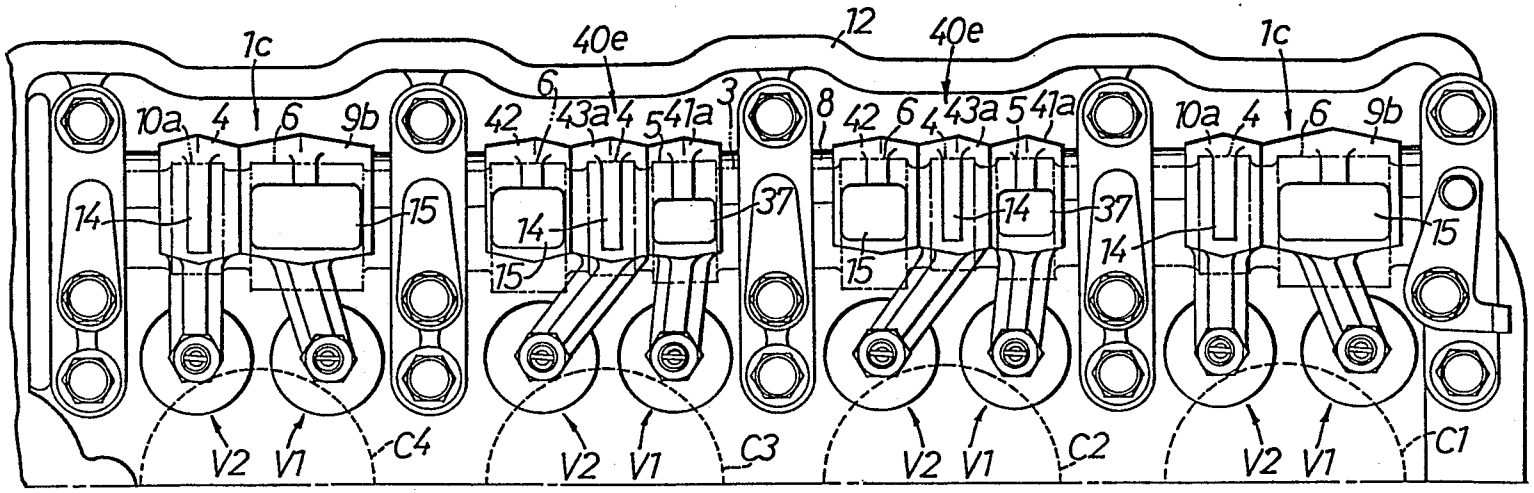

FIG. 14 shows an eighth embodiment of the present invention. The intake valves V1, V2 of the first and fourth cylinders C1, C4 are opened and closed by valve operating mechanisms 1*c*, whereas the intake valves V1, V2 of the second and third cylinders C2, C3 are opened and closed by valve operating mechanisms 40*e*.

Each of the valve operating mechanism 1*c* comprises a first rocker arm 9*b* having a cam slipper 25 held in slidable contact with the high-speed cam 6 and operatively associated with the intake valve V1, and a second rocker arm 10*a* having a sliding surface 14 held in slidable contact with the raised portion 4 and operatively associated with the intake valve V2. The rocker arms 9*b*, 10*a* are connectable under relatively low oil pressure.

Each of the valve operating mechanisms 40*e* comprises a first rocker arm 41*a* having a cam slipper 37 held in slidable contact with the low-speed cam 5 and operatively associated with the intake valve V1, a third rocker arm 43*a* having a sliding surface 14 held in slidable contact with the raised portion 4 and operatively associated with the intake valve V2, and a second rocker arm 42 having a cam slipper 15 held in slidable contact with the high-speed cam 6. The third rocker arm 43*a* is disposed between the first and second rocker arms 41*a*, 42. A selective coupling mechanisms (not shown) is disposed between the first and third rocker arms 41*a*, 43*a* for interconnecting the rocker arms 41*a*, 43*a* under relatively low oil pressure. Another selective coupling mechanism (not shown) is disposed between the third and second rocker arms 43*a*, 42 for interconnecting the rocker arms 43*a*, 42 under relatively high oil pressure.

According to this eighth embodiment, during low-speed operation of the engine, the intake valves V1 associated with the first and forth cylinders C1, C4 are opened and closed at the timing and lift according to the cam profile of the high-speed cams 6, and the intake valves V2 associated with the first and fourth cylinders C1, C4 are disabled or remain closed. The intake valves V1 associated with the second and third cylinders C2, C3 are opened and closed at the timing and lift according to the cam profile of the low-speed cams 5, and the intake valves V2 associated with the second and third cylinders C2, C3 are disabled or remain closed.

During medium-speed operation of the engine, the rocker arms 9*b*, 10*a* of the valve operating mechanisms 1*c* are interconnected, and the first and third rocker arms 41*a*, 43*a* of the valve operating mechanisms 40*e* are interconnected. Therefore, the intake valves V1, V2 associated with the first and fourth cylinders C1, C4 are opened and closed at the timing and lift according to the cam profile of the high-speed cams 6, and the intake valves V1, V2 associated with the second and third cylinders C2, C3 are opened and closed at the timing and lift according to the cam profile of the low-speed cams 5.

During high-speed operation of the engine, all of the rocker arms 9*b*, 10*a* of the valve operating mechanisms 1*c* and all of the rocker arms 41*a*, 42, 43*a* of the valve operating mechanisms 40*e* are interconnected. Therefore, the intake valves V1, V2 of all of the cylinders C1 through C4 are opened and closed at the timing and lift according to the cam profile of the high-speed cams 6.

Figure 15:
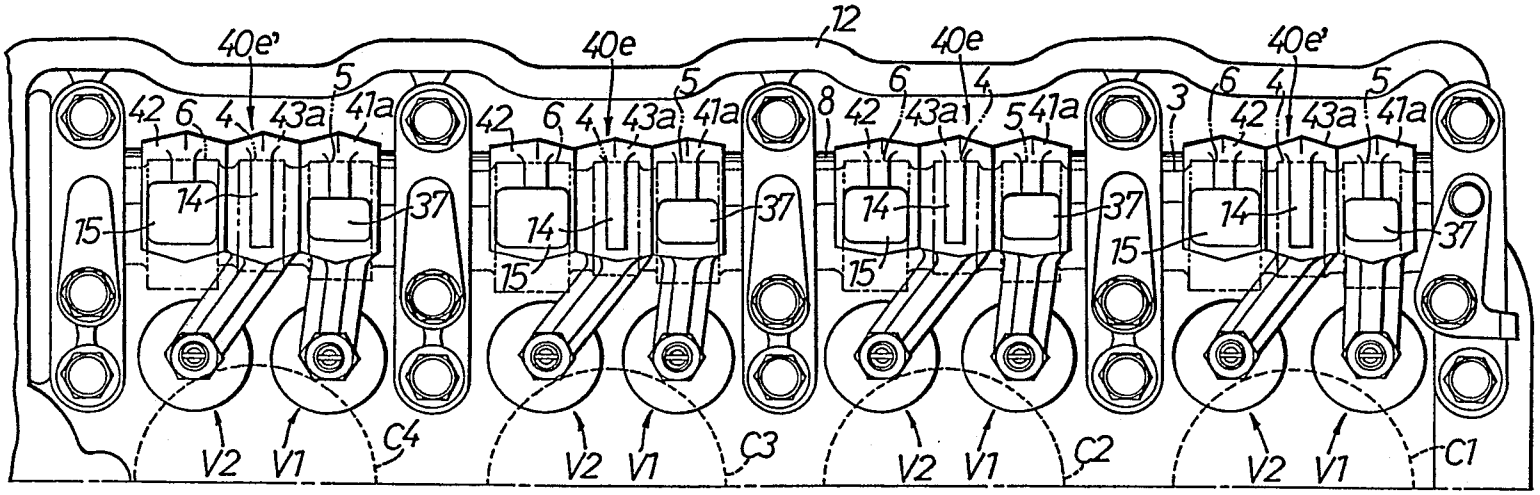

FIG. 15 shows a ninth embodiment of the present invention. The intake valves V1, V2 of the first and fourth cylinders C1, C4 are opened and closed by valve operating mechanisms 40*e*′, whereas the intake valves V1, V2 of the second and third cylinders C2, C3 are opened and closed by valve operating mechanisms 40*e*.

The valve operating mechanisms 40*e*, 40*e*′ have first, second, and third rocker arms 41*a*, 42, 43*a* arranged in the same pattern. In the valve operating mechanisms 40*e*, the first and third rocker arms 41*a*, 43*a* can be interconnected under relatively low oil pressure, whereas the third and second rocker arms 43*a*, 42 can be interconnected under relatively high oil pressure. In the other valve operating mechanisms 40*e*′, the third and second rocker arms 43*a*, 42 can be interconnected under relatively low oil pressure, and the first and third rocker arms 41*a*, 43*a* can be interconnected under relatively high oil pressure.

With the ninth embodiment, during low-speed operation of the engine, the intake valves V1 associated with all of the cylinders C1 through C4 are opened and closed at the timing and lift according to the cam profile of the low-speed cams 5, and the intake valves V2 associated with the cylinders C1 through C4 are disabled or remain closed.

During medium-speed operation of the engine, the intake valves V1 associated with the first and fourth cylinders C2, C4 are opened and closed at the timing and lift according to the cam profile of the low-speed cams 5, the intake valves V2 associated with the first and fourth cylinders C1, C4 are opened and closed at the timing and lift according to the cam profile of the high-speed cams 6, and the intake valves V1, V2 associated with the second and third cylinders C2, C3 are opened and closed at the timing and lift according to the cam profile of the low-speed cam 5.

During high-speed operation of the engine, the intake valves V1, V2 of all of the cylinders C1 through C4 are opened and closed at the timing and lift according to the cam profile of the high-speed cams 6.

Figure 16:
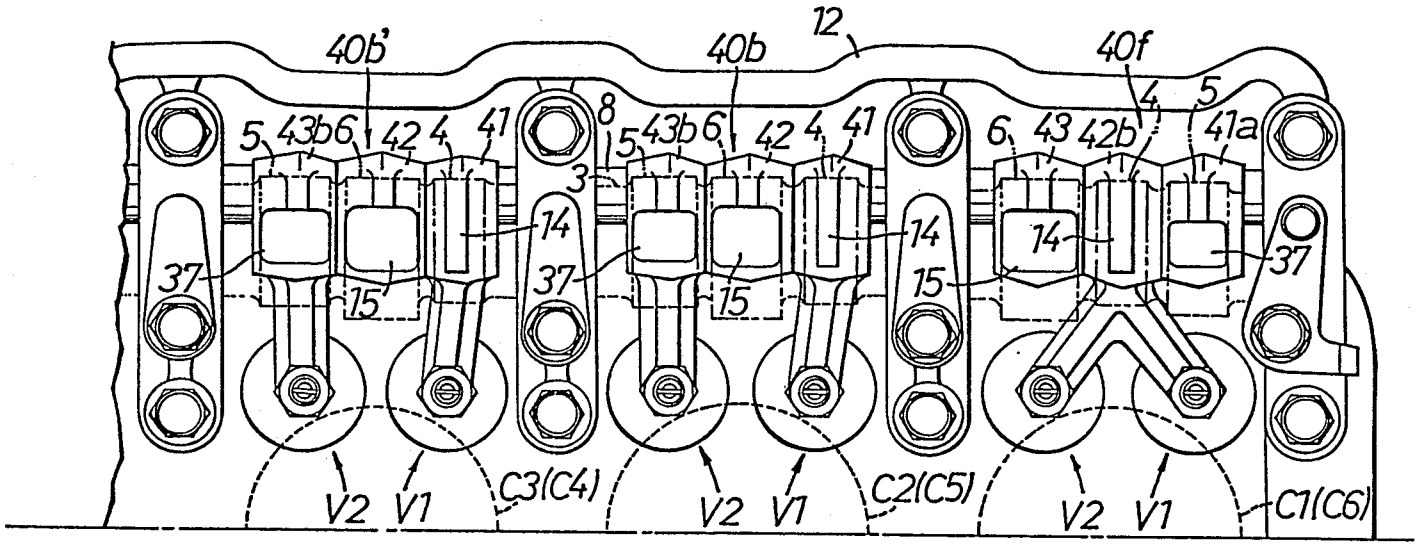

FIG. 16 illustrates a tenth embodiment of the present invention which is incorporated in a six-cylinder internal combustion engine. The intake valves V1, V2 of first and sixth cylinders C1, C6 can be opened and closed by valve operating mechanisms 40*f*, the intake valves V1, V2 of second and fifth cylinders C2, C5 can be opened and closed by valve operating mechanisms 40*b*, and the intake valves V1, V2 of third and fourth cylinders C3, C4 can be opened and closed by valve operating mechanisms 40*b*′.

Each of the valve operating mechanism 40*f* comprises a first rocker arm 41*a* having a cam slipper 37 held in slidable contact with the low-speed cam 5, a second rocker arm 42*b* having a sliding surface 14 held in slidable contact with the raised portion 4 and operatively associated with the intake valves V1, V2 and a third rocker arm 43 having a cam slipper 15 held in slidable contact with the high-speed cam 6. The second rocker arm 41*b* is disposed between the first and third rocker arms 41*a*, 43. The first and second rocker arms 41*a*, 42*b* can be interconnected when relatively low pressure is supplied, and the second and third rocker arms 42*b*, 43 can be interconnected when relatively high pressure is supplied.

Each of the valve operating mechanisms 40*b* is identical to the valve operating mechanisms according to the fifth embodiment shown in FIG. 5. all of the rocker arms 41, 42, 43*b* can be interconnected in response to relatively high oil pressure supplied.

Each of the valve operating mechanisms 40*b*′ includes first, second, and third rocker arms 41, 42, 43*b* arranged in the same pattern as that of the rocker arms of the valve operating mechanisms 40*b*. The first and second rocker arms 41, 42 can be coupled to each other when relatively low oil pressure is supplied, and the second and third rocker arms 42, 43*b* can be coupled to each other when relatively high oil pressure is supplied.

In the tenth embodiment, during low-speed operation of the engine, the intake valves V1, V2 associated with the first and sixth cylinders C1, C6 remain closed, the intake valves V1 associated with the second and fifth cylinders C2, C5 remain closed, and the intake valves V2 associated with the second and fifth cylinders C2, C5 are opened and closed at the timing and lift according to the cam profile of the low-speed cams 5. The intake valves V1 associated with the third and fourth cylinders C3, C4 remain closed, and the intake valves V2 associated with the third and fourth cylinders C3, C4 are opened and closed at the timing and lift according to the cam profile of the low-speed cams 5.

During medium-speed operation of the engine, the first and second rocker arms 41*a*, 42*b* of the valve operating mechanisms 40*f* are interconnected, and the first and second rocker arms 41, 42 of the valve operating mechanisms 40*b*′ are interconnected. Therefore, the intake valves V1, V2 associated with the first and sixth cylinders C2, C6 are opened and closed at the timing and lift according to the cam profile of the low-speed cams 5, the intake valves V1 associated with the second and fifth cylinders C2, C5 remain closed, and the intake valves V2 associated with the second and fifth cylinders C2, C5 are opened and closed at the timing and lift according to the cam profile of the low-speed cams 5. The intake valves V1 associated with the third and fourth cylinders C3, C4 are opened and closed at the timing and lift according to the cam profile of the high-speed cams 6, and the intake valves V2 associated with the third and fourth cylinders C3, C4 are opened and closed at the timing and lift according to the cam profile of the low-speed cams 5.

During high-speed operation of the engine, the rocker arms 41*a*, 42*b*, 43 and 41, 42, 43*b* and 41, 42, 43*b* of the valve operating mechanisms 40*f*, 40*b*, 40*b'*, respectively, are interconnected. Therefore, the intake valves V1, V2 associated with all of the cylinders C1 through C6 are opened and closed at the timing and lift according to the cam profile of the high-speed cams 6.

The principles of the present invention also are applicable to other multi-cylinder internal combustion engines such as three-, five- and eight- cylinder internal combustion engines in addition to the four- and six-cylinder internal combustion engines in the illustrated embodiments. The present invention can also be applied to a valve operating mechanism for operating exhaust valves.

With the present invention, as described above, the cylinders are divided into a plurality of groups, and each valve operating mechanism is arranged to operate the intake or exhaust valves of the cylinders in one of the groups in a different operation mode from the intake or exhaust valves of the cylinders in another group, at least under a certain operating condition of the engine. The valves can thus be operated in different modes among engine cylinders for performing valve operation control with high precision.

What is claimed:

1. A valve operating system for the intake or exhaust valves of a multicylinder internal combustion engine, comprising, a first valve operating means for causing operation of the intake or exhaust valves in first and second modes at different engine speeds, a second valve operating means for causing operation of the intake or exhaust valves in third and fourth modes at different engine speeds, at least one of said first or second modes being different from said third and fourth modes, said first valve operating means associated with at least one cylinder, and said second valve operating means associated with at least another cylinder different from said one cylinder.

2. A valve operating system for an internal combustion engine having a plurality of cylinders, said cylinders being arranged in groups having at least one cylinder each and a plurality of selectively operable valve operating mechanisms associated with each of said cylinders for opening and closing the intake or exhaust valves associated therewith, the valve operating mechanism for at least one cylinder group having a different operating mode under a certain engine operating condition than that for another group.

3. A valve operating system according to claim 2, wherein each of said selectively operable valve operating mechanisms has a plurality of cam followers movable in response to rotation of a common shaft shared by said cylinders, and a selectively operated coupling mechanism for interconnecting and disconnecting said cam followers.

4. A valve operating system according to claim 3 wherein each of said cam followers comprises a rocker arm pivotally supported on a rocker shaft.

5. A valve operating system according to claim 2 in which said plurality of valve operating mechanisms includes at least first and second selectively operable valve operating mechanisms that are operable to cause different opening and closing operation of the intake or exhaust valves associated each with a different cylinder group.

6. A valve operating system according to claim 5, wherein each of said first and second selectively operable valve operating mechanisms has a plurality of cam followers movable in response to rotation of a common camshaft shared by the cylinders, and a selectively operated coupling mechanism for selectively interconnecting and disconnecting the cam followers.

7. A valve operating system according to claim 6, wherein each of said cam followers comprises a rocker arm pivotally supported on a rocker shaft.

8. A valve operating system according to claim 5, wherein a third selectively operable valve operating mechanism is provided that causes different operation of the intake or exhaust valves than said first and second selectively operable valve operating mechanisms, at least under a certain operating condition of the engine.

9. A valve operating system according to claim 5, wherein at least one of said first and second selectively operable valve operating mechanisms includes means for operating the intake or exhaust valves associated therewith in three different manners for low, medium and high speed engine operation.

10. A valve operating system according to claim 5, wherein one-half of the cylinders have valves operated by said first selectively operable valve operating mechanisms and the other half of the cylinders have valves operated by said second selectively operable valve operating mechanisms.

11. A valve operating system according to claim 5, wherein said first selectively operable valve operating mechanisms is operable for maintaining the intake or exhaust valves operated thereby in a closed condition at low engine speed.

* * * * *